US006559117B1

(12) United States Patent
Severns et al.

(10) Patent No.: US 6,559,117 B1
(45) Date of Patent: May 6, 2003

(54) VISCOSITY STABLE CONCENTRATED LIQUID FABRIC SOFTENER COMPOSITIONS

(75) Inventors: John Cort Severns, West Chester, OH (US); Alice Marie Vogel, Middletown, OH (US); Errol Hoffman Wahl, Montgomery, OH (US); Robert Mermelstein, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 08/545,470

(22) Filed: Oct. 19, 1995

Related U.S. Application Data

(63) Continuation-in-part of application No. 08/408,336, filed on Mar. 22, 1995, now abandoned, which is a continuation of application No. 08/166,113, filed on Dec. 13, 1993, now abandoned.

(51) Int. Cl.[7] ..... C11D 1/645; C11D 3/00

(52) U.S. Cl. ..... 510/515; 510/276; 510/329; 510/330; 510/504; 510/521; 510/522; 510/527

(58) Field of Search ..... 252/8.6, 8.75, 252/8.8; 510/515, 521, 522, 527, 276, 329, 330, 504

(56) References Cited

U.S. PATENT DOCUMENTS

| | | | | |
|---|---|---|---|---|
| 3,681,241 | A | 8/1972 | Rudy | 252/8.75 |
| 3,915,867 | A | 10/1975 | Kang et al. | 252/8.8 |
| 4,076,632 | A | 2/1978 | Davis | 252/8.8 |
| 4,134,840 | A | 1/1979 | Minegishi et al. | 252/8.9 |
| 4,137,180 | A | 1/1979 | Naik et al. | 252/8.8 |
| 4,155,855 | A | 5/1979 | Goffinet et al. | 252/8.8 |
| 4,157,307 | A | 6/1979 | Jaeger et al. | 252/8.75 |
| 4,399,045 | A | 8/1983 | Burns | |
| 4,401,578 | A | 8/1983 | Verbruggen | 252/8.8 |
| 4,422,949 | A | 12/1983 | Ooms | 252/8.8 |
| 4,426,299 | A | 1/1984 | Verbruggen | 252/8.8 |
| 4,439,330 | A | 3/1984 | Ooms | 252/8.8 |
| 4,439,335 | A | 3/1984 | Burns | 252/8.75 |
| 4,454,049 | A | 6/1984 | MacGilp et al. | 252/8.8 |
| 4,661,267 | A | 4/1987 | Dekker et al. | 252/8.8 |
| 4,711,730 | A | 12/1987 | Gosselink et al. | 252/8.75 |
| 4,724,089 | A | 2/1988 | Konig et al. | 252/8.8 |
| 4,749,596 | A | 6/1988 | Evans et al. | 427/242 |
| 4,767,547 | A | 8/1988 | Straathof et al. | 252/8.8 |
| 4,806,255 | A | 2/1989 | Konig et al. | 252/8.8 |
| 4,818,569 | A | 4/1989 | Trinh et al. | 427/242 |
| 4,933,096 | A | 6/1990 | Demeyere et al. | 252/8.8 |
| 4,954,635 | A | 9/1990 | Rosario-Jansen et al. | 548/354 |
| 4,956,447 | A | 9/1990 | Gosselink et al. | 528/272 |
| 4,963,274 | A | 10/1990 | Wulf et al. | |
| 4,976,879 | A | 12/1990 | Maldonado et al. | 252/8.7 |
| 4,999,121 | A | 3/1991 | De Block et al. | 252/8.8 |
| 5,013,846 | A | 5/1991 | Walley | 548/352 |
| 5,065,628 | A | 11/1991 | Benecke | |
| 5,066,414 | A | 11/1991 | Chang | 252/8.8 |
| 5,133,885 | A | 7/1992 | Contor et al. | |
| 5,234,611 | A | 8/1993 | Trinh et al. | 252/8.8 |
| 5,403,499 | A | 4/1995 | Kiefer et al. | 252/8.6 |
| 5,407,589 | A | 4/1995 | Turner | |
| 5,545,340 | A | 8/1996 | Wahl et al. | |
| 5,562,849 | A | 10/1996 | Wahl et al. | |
| 5,574,179 | A | 11/1996 | Wahl et al. | |
| 5,637,743 | A | 6/1997 | Contet et al. | |
| 5,750,491 | A | 5/1998 | DeBlock et al. | |
| 5,759,990 | A * | 6/1998 | Wahl et al. | 510/515 |
| 5,830,845 | A * | 11/1998 | Trinh et al. | 510/504 |
| 5,861,370 | A * | 1/1999 | Trinh et al. | 510/504 |
| 5,877,145 | A * | 3/1999 | Wahl et al. | 510/515 |

FOREIGN PATENT DOCUMENTS

| | | | |
|---|---|---|---|
| EP | A 0 000 406 | 1/1979 | D06M/13/46 |
| EP | A 0 345 842 | 12/1989 | C11D/1/645 |
| EP | A 0 404 471 | 12/1990 | C11D/3/00 |
| EP | 0 507 478 A1 | 10/1992 | C11D/1/835 |
| GB | 1 601 360 | 10/1981 | D06M/13/36 |
| WO | WO 93/01265 | 1/1993 | C11D/1/46 |
| WO | WO-95/16766 * | 6/1995 | |
| WO | WO 89/11522 | 11/1999 | C11D/1/62 |

OTHER PUBLICATIONS

Journal of American Oil Chemists Society 74:(9) 1223–1225 (no date).

Journal of American Oil Chemists Society 74:(9) 1077–1083 (no date).

* cited by examiner

*Primary Examiner*—Anthony Green
(74) *Attorney, Agent, or Firm*—Jason J. Camp; Kim William Zerby; Steven W. Miller

(57) ABSTRACT

Viscosity stable, concentrated, aqueous, liquid fabric softening compositions contain a mixture of biodegradable diester quaternary ammonium softening materials and specific co-active fabric softening materials which include substituted imidazoline compounds and specific quaternary ammonium salts. The compositions have superior stability at both normal and lower temperatures. The best process for preparing such compositions uses a molten premix of the fabric softening materials which is dispersed in an aqueous phase through the use of high shear milling.

28 Claims, No Drawings

VISCOSITY STABLE CONCENTRATED LIQUID FABRIC SOFTENER COMPOSITIONS

This is a continuation-in-part of application Ser. No. 08/408,336, filed on Mar. 22, 1995, now abandoned, which is a continuation of application Ser. No 08/166,113, filed on Dec. 13, 1993, now abandoned.

TECHNICAL FIELD

The present invention relates to concentrated aqueous textile treatment compositions. In particular, it relates to textile treatment compositions for use in the rinse cycle of a textile laundering operation to provide fabric softening/static control benefits, the compositions being characterized by excellent storage stability and excellent viscosity stability after freeze/thaw cycling.

BACKGROUND OF THE INVENTION

Aqueous textile treatment compositions suitable for providing fabric softening and static control benefits during laundering are well-known in the art and have found wide-scale commercial application. Conventionally, aqueous, rinse-added, fabric softening compositions contain, as the active softening component, substantially water-insoluble cationic materials having two long alkyl chains. Typical of such materials are di-hydrogenated tallow di-methyl ammonium chloride and imidazolinium compounds substituted with two stearyl groups. These materials are normally prepared in the form of a dispersion in water. It is generally not possible to prepare such aqueous dispersions with more than about 10% cationic materials without encountering intractable problems of product viscosity and stability, especially after storage at lower temperatures, such that the compositions are unpourable and have inadequate dispensing and dissolving characteristics in rinse water. This physical restriction on softener concentration limits the level of softening performance achievable without using excessive amounts of product and also adds substantially to the costs of distribution and packaging. Accordingly, it would be highly desirable to prepare physically acceptable aqueous textile treatment compositions containing much higher levels of substantially water-insoluble cationic softener materials.

Cationic softener materials are normally supplied by the manufacturer containing about 70%–90% of active material in an organic liquid such as isopropanol or ethanol, sometimes containing a minor amount of water (up to 10%). Retail fabric softening compositions are then prepared by dispersion of the softener in warm or hot water under carefully controlled conditions. The physical form and dispersibility constraints of these industrial concentrates are such as to preclude their direct use by the domestic consumer; indeed, they can pose severe processing problems even for the industrial supplier of retail fabric softening compositions.

Many of the various solutions to the specific problem of preparing aqueous fabric softening compositions in concentrated form suitable for consumer use have not been entirely satisfactory. It is generally known (for example, in U.S. Pat. No. 3,681,241, Rudy, issued Aug. 1, 1972) that the presence of ionizable salts in softener compositions does help reduce viscosity, but this approach by itself is ineffective in preparing compositions containing more than about 12% of dispersed softener, inasmuch as the level of ionizable salts necessary to reduce viscosity to any substantial degree has a seriously detrimental effect on product viscosity stability.

SUMMARY OF THE INVENTION

It has now been discovered that the product stability and viscosity characteristics of concentrated fabric softener compositions containing mixtures of (A) biodegradable diester quaternary ammonium softening materials, (hereinafter referred to as "(A)"), and (B) specific co-active fabric softening materials, (hereinafter referred to as "(B)"), (i.e., substituted imidazoline compounds and specific quaternary ammonium salts which are not the same as (A)), are superior both at normal and lower temperatures. The value of using such mixtures of fabric softening materials for enhancing the long term viscosity characteristics and stability of concentrated aqueous cationic fabric compositions especially after freeze/thaw cycling, has hitherto not been recognized in the art.

DETAILED DESCRIPTION OF THE INVENTION

(A). Biodegradable Quaternized Ester-Amine Softening Material

The present invention contains diester quaternary ammonium material (hereinafter referred to as "DEQA") as an essential component. The DEQA preferably comprises, as the primary active, compounds of the formula:

$$\left[(R)_{4-m}-N^{(+)}-[(CH_2)_n-Y-R^2]_m\right] \quad X^{(-)}$$

wherein each R substituent is a short chain $C_1$–$C_6$, preferably $C_1$–$C_3$ alkyl or hydroxyalkyl group, e.g., methyl (most preferred), ethyl, propyl, hydroxyethyl, and the like, benzyl or mixtures thereof; each m is 2 or 3; each n is from 1 to about 4; each Y is —O—(O)C—, or —C(O)—O—, but not —OC(O)O—; each $R^2$ is a long chain $C_{12}$–$C_{22}$ hydrocarbyl, or substituted hydrocarbyl substituent, preferably $C_{15}$–$C_{19}$ alkyl or alkylene, most preferably $C_{15}$–$C_{17}$ straight chain alkyl or alkylene such that the Iodine Value (hereinafter referred to as IV) of the parent fatty acid of this $R^2$ group is less than about 10, preferably less than about 5, most preferably less than about 2; and the counterion, X(−), can be any softener-compatible anion, preferably the anion of a strong acid, for example, chloride, bromide, methylsulfate, formate, sulfate, nitrate and the like. The anion can also, but less preferably, carry a double charge in which case X(−) represents half a group. These materials containing a divalent anion, in general, are more difficult to formulate as stable concentrated liquid compositions.

Carbonate esters, i.e., where Y=—O—C(O)O—, are unstable compounds and are not included as DEQA (A) compounds.

It will be understood that substituents R and $R^2$ can optionally be substituted with various groups such as alkoxyl or hydroxyl groups, and can be straight, or branched so long as the $R^2$ groups maintain their basically hydrophobic character. The preferred compounds can be considered to be diester variations of ditallow dimethyl ammonium chloride (hereinafter referred to as "DTDMAC"), which is a widely used fabric softener. At least 80% of the DEQA is in the diester form, and from 0% to about 20% can be DEQA monoester (e.g., only one of the ester groups is hydrolyzed to yield either —Y—H, or an —OH group).

As used herein, when the diester is specified, it can include the monoester that is present. For softening, under no/low detergent carry-over laundry conditions the percentage of monoester should be as low as possible, preferably no more than about 2.5%. However, under high, anionic detergent surfactant or detergent builder carry-over conditions, some monoester can be preferred. The overall ratios of diester to monoester are from about 100:1 to about 2:1, preferably from about 50:1 to about 5:1, more preferably from about 13:1 to about 8:1. Under high detergent carry-over conditions, the di/monoester ratio is preferably about 11:1. The level of monoester present can be controlled in manufacturing the DEQA.

The above compounds, used as the biodegradable quaternized ester-amine softening material in the practice of this invention, can be prepared using standard reaction chemistry. In one synthesis of a di-ester variation of DTDMAC, an amine of the formula $RN(CH_2CH_2OH)_2$ is esterified at both hydroxyl groups with an acid chloride of the formula $R^2C(O)Cl$, then quaternized with an alkyl halide, RX to yield the desired reaction product (wherein R and $R^2$ are as defined hereinbefore). However, it will be appreciated by those skilled in the chemical arts that this reaction sequence allows a broad selection of agents to be prepared. The following are non-limiting examples (wherein all long-chain alkyl substituents are straight-chain):

$[HO—CH(CH_3)CH_2][CH_3]N^{(+)}[CH_2CH_2OC(O)C_{15}H_{31}]_2 \quad Br^{(-)}$ $[C_2H_5]_2N^{(+)}[CH_2CH_2OC(O)C_{17}H_{35}]_2 \quad Cl^{(-)}$ $[CH_3][C_2H_5]N^{(+)}[CH_2CH_2OC(O)C_{13}H_{27}]_2 I^{(-)}$ $[C_3H_7][C_2H_5]N^{(+)}[CH_2CH_2OC(O)C_{15}H_{31}]_2 \quad [SO_4CH_3]^{(-)}$ $[CH_3]_2N^{(+)}(CH_2CH_2OC(O)C_{17}H_{35})—CH_2CH_2OC(O)C_{15}H_{31} \quad Cl^{(-)}$ $[CH_2CH_2OH][CH_3]N^{(+)}[CH_2CH_2OC(O)R^2]_2 \quad Cl^{(-)}$ $[CH_3]_2N^{(+)}[CH_2CH_2OC(O)R^2]_2 \quad Cl^{(-)}$ where $—C(O)R^2$ is derived from hardened tallow fatty acid.

Since the foregoing materials (diesters) are somewhat labile to hydrolysis, they should be handled rather carefully when used to formulate the fabric softening composition herein. For example, stable liquid compositions herein are formulated at a neat pH in the range of from about 2 to about 5, preferably from about 2 to about 4.5, more preferably from about 2.5 to about 4. The pH can be adjusted by the addition of a Bronsted acid. pH ranges for making stable softener compositions containing diester quaternary ammonium fabric softening compounds are disclosed in U.S. Pat. No. 4,767,547, Straathof, issued Aug. 30, 1988, which is incorporated herein by reference.

Examples of suitable Bronsted acids include the inorganic mineral acids, carboxylic acids, in particular the low molecular weight ($C_1$–$C_5$) carboxylic acids, and alkylsulfonic acids. Suitable inorganic acids include HCl, $H_2SO_4$, $HNO_3$ and $H_3PO_4$. Suitable organic acids include formic, acetic, citric, methylsulfonic and ethylsulfonic acids. Preferred acids are hydrochloric, phosphoric, and citric acids.

(B). The Co-Active Fabric Softening Material

Compositions prepared by the present invention contain as an essential component a co-active fabric softening material, as described hereinafter, which is different from the biodegradable diester quaternary ammonium softening material (A):

1. One such co-active fabric softening material is a substituted imidazoline fabric softener material with the primary active having the formula:

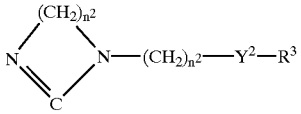

(1)

wherein each $Y^2$ is either: $—N(R^4)C(O)—$, in which each $R^4$ is selected from the group consisting of $C_1$–$C_6$ alkyl, alkenyl, hydroxy alkyl group or hydrogen; —OC(O)—; or a single covalent bond; wherein each $R^3$ is independently, hydrocarbyl, preferably alkyl, groups containing from about 11 to about 31, preferably from about 13 to about 17, carbon atoms, more preferably straight chain alkyl groups, and wherein each $n^2$ independently is from about 2 to about 4, preferably with both $n^2$'s being 2. It will be understood that each $R^3$ can optionally be substituted with various groups such as alkoxyl or hydroxyl, or can be branched, but such materials are not preferred herein. In addition $R^3$ can optionally be unsaturated (e.g., alkenyl groups).

The above materials used as the co-active fabric softening material in the practice of this invention are prepared using standard reaction chemistry. Disclosure of imidazoline fabric softener materials useful herein can be found in U.S. Pat. No. : 4,661,267, Dekker, Konig, Straathof, and Gosselink, issued Apr. 28, 1987; U.S. Pat. No. 4,724,089, Konig and Buzzaccarini, issued Feb. 9, 1988; 4,806,255, Konig and Buzzaccarini, issued Feb. 21, 1989; U.S. Pat. No. 4,855,072, Trinh, Wahl, Swartley, and Hemingway, issued Aug. 8, 1989; U.S. Pat. No. 4,933,096, DeMeyere, Hardy, and Konig, issued Jun. 12, 1990; and U.S. Pat. No. 4,954,635, Rosario-Jansen and Lichtenwalter, issued Sept. 4, 1990; all of said patents being incorporated herein by reference.

A preferred co-active fabric softening material of the present invention is the reaction product of higher fatty acids with a polyamine selected from the group consisting of hydroxyalkylenediamines and dialkylenetriamines and mixtures thereof, the process of which is disclosed in U.S. Pat. No. 5,013,846, Walley, issued May 7, 1993 and incorporated herein by reference. These reaction products are mixtures of several compounds in view of the multifunctional structures of polyamines (see, for example, the publication by H. W. Eckert in Fette-Seifen-Anstrichmittel, September 1972, pages 527–533).

For example, in a typical synthesis of a substituted imidazoline ester softening material of formula above, a fatty acid of the formula $R^3COOH$ is reacted with a hydroxyalkylenediamine of the formula $NH_2—(CH_2)_n2—NH—(CH_2)_n2OH$ to form an intermediate imidazoline precursor, which is then reacted with a methyl ester of a fatty acid of the formula:

$R^3C(O)OCH_3$ to yield the desired reaction product (wherein $R^3$, and $n^2$ are as defined above). It will be appreciated by those of ordinary skill in the chemical arts that this reaction sequence allows a broad selection of materials to be prepared. As illustrative, nonlimiting examples there can be mentioned the following di-alkyl imidazoline compounds (wherein all long-chain alkyl substituents are straight-chain)): 1-stearoyl oxyethyl-2-stearyl imidazoline, 1-stearoyl oxyethyl-2-palmityl imidazoline, 1-stearoyl oxyethyl-2-myristyl imidazoline, 1-palmitoyl oxyethyl-2-palmityl imidazoline, 1-palmitoyl oxyethyl-2-myristyl imidazoline, 1-stearoyl oxyethyl-2-tallow imidazoline, 1-myristoyl oxyethyl-2-tallow imidazoline, 1-palmitoyl oxyethyl-2-tallow imidazoline, 1-cocyl oxyethyl-2-coconut imidazoline, 1-tallowyl oxyethyl-2-tallow imidazoline, 1-[hydrogenated tallowyl amido]ethyl-2-hydrogenated tallow imidazoline, 1-[stearyl amido]ethyl-2-stearyl imidazoline, 1-[palmityl amido]ethyl-2-palmityl imidazoline, 1-[oleyl amido]ethyl-2-oleyl imidazoline, and mixtures of such imidazoline materials.

Other types of substituted imidazoline softening materials can also be used herein. Examples of such materials include:

(i)

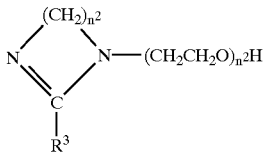

(ii)

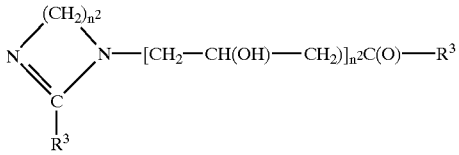

(iii)

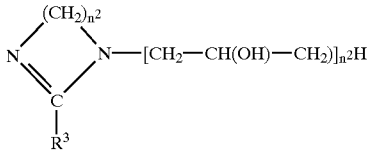

wherein $R^3$, and $n^2$ are as previously defined. The above list is intended to be illustrative of other types of substituted imidazoline softening materials which can optionally be used in the present invention, but which are not preferred.

2. The Di(2-amidoethyl)methyl quaternary ammonium salts are also suitable for use as Component (B) in the compositions of the invention herein, especially those having the formula:

(2)

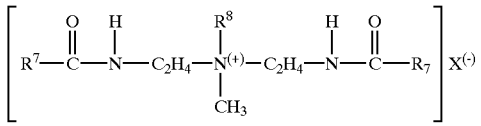

wherein each $R^7$ is selected from the group consisting of $C_{14}$ to $C_{20}$ alkyl and alkenyl groups, wherein each $R^8$ is selected from methyl, ethyl, and $—(C_mH_{2m}O)_n3H$, wherein $n^3$ is from 1 to about 5, preferably 3, and wherein m, and $X^{(-)}$ have the same meaning as before. This class of agents is disclosed in U.S. Pat. No. 4,134,840, Minegishi et al., issued Jan. 16, 1979, incorporated herein by reference.

Exemplary materials are di((2-hydrogenatedtallowamidoethyl) ethoxylated (2 ethoxy groups) methyl ammonium methylsulfate, di(2-oleylamidoethyl) propoxylated (3-propoxy groups) methyl ammonium bromide, di(2-palmitoleylamidoethyl) dimethyl ammonium ethylsulfate and di(2-stearylamidoethyl) propoxylated (2 propoxy groups) methyl ammonium methyl sulfate.

An exemplary commercial material suitable for use as Component (B) herein is di(2-tallowamidoethyl) ethoxylated methyl ammonium methylsulfate (such that the I.V. Component B is about 31) sold under the name Varisoft 222, from Witco Chemical Company.

3. A co-active fabric softening material for use as component (B) in the composition of the invention herein can also have the formula:

(3)

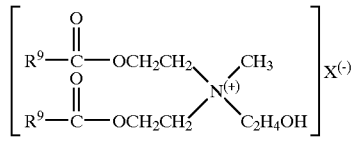

wherein each $R^9$ is $C_{15}$–$C_{17}$ alkyl group such that the IV of the parent fatty acid of this $R^9$ group is from about 20 to about 100, preferably from about 30 to about 70, most preferably from about 35 to about 60; and $X^{(-)}$ has the same meaning as before.

A preferred fabric softening material of the present invention is prepared according to the synthesis disclosed in U.S. Pat. No. 3,915,867, Kang et al., issued Oct. 28, 1975 and incorporated herein by reference. The fabric softening material of this invention generally comprises the reaction of purified $C_{14}$–$C_{18}$ fatty acid alkylester mixture, triethanolamine, and a quaternizing reagent, preferably dimethyl sulfate. The select fatty acid alkylesters are preferably a mixture of substantial amounts of oleic, palmitic, stearic acid alkyl esters and may include minor amounts of other fatty substances.

4. A co-active fabric softening material suitable for use as Component (B) in the composition of the invention can also have the formula:

(4)

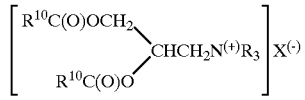

wherein each $R^{10}$ is a $C_{12}$–$C_{22}$ hydrocarbyl or substituted hydrocarbyl substituent, preferably $C_{15}$–$C_{19}$ alkyl or alkylene, most preferably $C_{15}$–$C_{17}$ straight chain alkyl or alkylene such that the IV of the parent fatty acid of this $R^{10}$ group is from about 20 to about 100, preferably from about 30 to about 70, most preferably from about 35 to about 60; and R and $X^{(-)}$ have the same meaning as before.

Tallow is a convenient and inexpensive source of long chain alkyl and alkenyl materials.

A specific example of a diester quaternary ammonium compound suitable for use in this invention herein include:

1,2-ditallowyloxy-3-(trimethyl ammonio)propane chloride.

Other examples of suitable diester quaternary ammoniums of this invention are obtained by, e.g.: replacing "tallowyl" in the above compounds with, for example, cocoyl, palmoyl, lauryl, oleyl, stearyl, palmityl, or the like; replacing "methyl" in the above compounds with ethyl, propyl, isopropyl, butyl, isobutyl, t-butyl, or the hydroxy substituted analogs of these radicals; replacing "chloride" in the above compounds with bromide, methylsulfate, formate, sulfate, nitrate, and the like.

In fact, the anion is merely present as a counterion of the positively charged quaternary ammonium compounds disclosed herein. The scope of this invention is not considered limited to any particular anion.

The materials herein can be prepared by standard esterification and quaternization reactions, using readily available starting materials. General methods for preparation are disclosed in U.S. Pat. No. 4,137,180, incorporated herein by reference.

The present invention may also contain mixtures of the various co-active fabric softening materials.

The compositions of the present invention herein comprise from about 15% to about 35%, preferably from about 20% to about 32%, most preferably from about 22% to about 27% of component (A)+component (B).

The ratio of component (A) to component (B) is from about 0.2:1 to about 8:1, preferably from about 0.25:1 to about 4:1, most preferably from about 0.3:1 to about 1.5:1.

(C). The Acid Component

The present invention utilizes an acid of sufficient concentration to keep the pH at the desired level and optionally, to fully protonate component (B) to the extent that it is not already quaternized. The composition of the present invention is prepared using a molten premix of components (A)+(B), (hereinafter referred to as premix). The premix is injected into an acid/water seat, then high shear milling is conducted and, electrolyte is added in no specific order. The electrolyte is selected from the group consisting of the Group IA and IIA metals of the periodic table of elements, e.g., calcium chloride, sodium chloride, potassium bromide, and lithium chloride, and ammonium salts, e.g., ammonium chloride and lysine HCl. Typically, the acid/water seat has an acid concentration up to about 2%.

Typically the acid to (B) molar ratio is from about 0:1 to about 1.2:1. Typically the acid to (A) molar ratio is from about 0:1 to about 0.2:1. The neat pH of the final composition is preferably from about 2.5 to about 4.

Suitable acids include the Bronsted acids, especially inorganic mineral acids and organic acids such as carboxylic acids. Carboxylic acids include, in particular, the low molecular weight ($C_1$–$C_5$) carboxylic acids of the formula $R^{12}$—COOH ($R^{12}$ being a $C_1$–$C_5$ or H alkyl group). Suitable organic acids are selected from the group having the formula $R^{13}CH_2SO_3H$, wherein $R^{13}$ is hydrogen or $C_1$ to $C_4$ alkyl. Suitable specific organic acids include formic, methylsulfonic, ethylsulfonic, citric, gluconic, and aromatic carboxylic acids like benzoic acid. Suitable inorganic acids include HCl, HBr, $H_2SO_4$, $H_2SO_3$, HNO3, and $H_3PO_4$.

Preferred acids are phosphoric, formic, acetic, hydrochloric, citric, and methylsulfonic acids. Mixtures of the above organic and inorganic acids are also suitable. Typically, acids such as citric, hydrochloric, phosphoric, and sulfuric are used because of their low cost and availability.

(D). Liquid Carrier

The compositions of the present invention herein comprise from about 60% to about 90%, preferably from about 65% to about 85% of an aqueous liquid carrier.

The preferred aqueous carrier is water which can contain minor ingredients.

(E). Optional Ingredients

Fully-formulated fabric softening compositions made by the process of the present invention can optionally contain one or more of the following ingredients.

1. Silicone Component

The fabric softening compositions herein optionally contain an aqueous emulsion of a predominantly linear polydialkyl or alkyl aryl siloxane in which the alkyl groups can have from one to five carbon atoms and can be wholly, or partially, fluoridated. These siloxanes act to provide improved fabric benefits. Suitable silicones are polydimethyl siloxanes having a viscosity, at 25° C., of from about 100 to about 100,000 centistokes, preferably from about 1,000 to about 12,000 centistokes. In some applications as low as 1 centistoke materials are preferred.

The fabric softening compositions herein can contain from about 0.1% to about 10%, of the silicone component.

2. Thickening Agent

Optionally, the fabric softening compositions herein contain from 0% to about 3%, preferably from about 0.01% to about 2%, of a thickening agent. Examples of suitable thickening agents include: cellulose derivatives, synthetic high molecular weight polymers (e.g., carboxyvinyl polymer and polyvinyl alcohol), and cationic guar gums.

The cellulosic derivatives that are functional as thickening agents herein can be characterized as certain hydroxyethers of cellulose, such as Methocel, marketed by Dow Chemicals, Inc.; also, certain cationic cellulose ether derivatives, such as Polymer JR-125, JR-400, and JR-30M, marketed by Union Carbide.

Other effective thickening agents are cationic guar gums, such as Jaguar Plus, marketed by Stein Hall, and Gendrive 458, marketed by General Mills.

Preferred thickening agents herein are selected from the group consisting of methyl cellulose, hydroxypropyl methylcellulose, hydroxybutyl methylcellulose, or mixtures thereof, said cellulosic polymer having a viscosity in 2% aqueous solution at 20C of from about 15 to about 75,000 centipoises.

3. Soil Release Agent

In the present invention, an optional soil release agent may be added. The addition of the soil release agent may occur in combination with the premix, in combination with the acid/water seat, before or after electrolyte addition, or after the final composition is made. The softening composition prepared by the process of the present invention herein can contain from 0% to about 10%, preferably from 0.2% to about 5%, of a soil release agent. Preferably, such a soil release agent is a polymer. Polymeric soil release agents useful in the present invention include copolymeric blocks of terephthalate and polyethylene oxide or polypropylene oxide, and the like.

A preferred soil release agent is a copolymer having blocks of terephthalate and polyethylene oxide. More specifically, these polymers are comprised of repeating units of ethylene terephthalate and polyethylene oxide terephthalate at a molar ratio of ethylene terephthalate units to polyethylene oxide terephthalate units of from 25:75 to about 35:65, said polyethylene oxide terephthalate containing polyethylene oxide blocks having molecular weights of from about 300 to about 2000. The molecular weight of this polymeric soil release agent is in the range of from about 5,000 to about 55,000.

Another preferred polymeric soil release agent is a crystallizable polyester with repeat units of ethylene terephthalate units containing from about 10% to about 15% by weight of ethylene terephthalate units together with from about 10% to about 50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between 2:1 and 6:1. Examples of this polymer include the commercially available materials Zelcon 4780 (from Dupont) and Milease T (from ICI).

Highly preferred soil release agents are polymers of the generic formula:

$$X-(OCH_2CH_2)_p(O-\overset{O}{\overset{\|}{C}}-R^{14}-\overset{O}{\overset{\|}{C}}-OR^{15})_u(O-\overset{O}{\overset{\|}{C}}-R^{14}-O\overset{O}{\overset{\|}{C}}-O)(CH_2CH_2O-)_n-X$$

in which each X can be a suitable capping group, with each X typically being selected from the group consisting of H, and alkyl or acyl groups containing from about 1 to about 4 carbon atoms. p is selected for water solubility and generally is from about 6 to about 113, preferably from about 20 to about 50 u is critical to formulation in a liquid composition having a relatively high ionic strength. There should be very little material in which u is greater than 10. Furthermore, there should be at least 20%, preferably at least 40%, of material in which u ranges from about 3 to about 5.

The $R^{14}$ moieties are essentially 1,4-phenylene moieties. As used herein, the term "the $R^{14}$ moieties are essentially 1,4-phenylene moieties" refers to compounds where the $R^{14}$ moieties consist entirely of 1,4-phenylene moieties, or are partially substituted with other arylene or alkarylene moieties, alkylene moieties, alkenylene moieties, or mixtures thereof. Arylene and alkarylene moieties which can be partially substituted for 1,4-phenylene include 1,3-phenylene, 1,2-phenylene, 1,8-naphthylene, 1,4-naphthylene, 2,2-biphenylene, 4,4-biphenylene, and mixtures thereof Alkylene and alkenylene moieties which can be partially substituted include 1,2-propylene, 1,4-butylene, 1,5-pentylene, 1,6-hexamethylene, 1,7-heptamethylene, 1,8-octamethylene, 1,4-cyclohexylene, and mixtures thereof.

For the $R^{14}$ moieties, the degree of partial substitution with moieties other than 1,4-phenylene should be such that the soil release properties of the compound are not adversely affected to any great extent. Generally the degree of partial substitution which can be tolerated will depend upon the backbone length of the compound, i.e., longer backbones can have greater partial substitution for 1,4-phylene moieties. Usually, compounds where the $R^{14}$ comprise from about 50% to about 100% 1,4-phenylene moieties (from 0% to about 50% moieties other than 1,4-phenylene) have adequate soil release activity. For example, polyesters made according to the present invention with a 40:60 mole ratio of isophthalic (1,3-phenylene) to terephthalic (1,4-phenylene) acid have adequate soil release activity. However, because most polyesters used in fiber making comprise ethylene terephthalate units, it is usually desirable to minimize the degree of partial substitution with moieties other than 1,4-phenylene for best soil release activity. Preferably, the $R^{14}$ moieties consist entirely of (i.e., comprise 100%) 1,4-phenylene moieties, i.e., each $R^{14}$ moiety is 1,4-phenylene.

For the $R^{15}$ moieties, suitable ethylene or substituted ethylene moieties include ethylene, 1,2-propylene, 1,2-butylene, 1,2-hexylene, 3-methoxy-1,2-propylene, and mixtures thereof Preferably, the $R^{15}$ moieties are essentially ethylene moieties, 1,2-propylene moieties, or mixtures thereof. Inclusion of a greater percentage of ethylene moieties tends to improve the soil release activity of compounds. Surprisingly, inclusion of a greater percentage of 1,2-propylene moieties tends to improve the water solubility of compounds.

Therefore, the use of 1,2-propylene moieties or a similar branched equivalent is desirable for incorporation of any substantial part of the soil release component in the liquid fabric softener compositions. Preferably, from about 75% to about 100%, are 1,2-propylene moieties.

The value for each p is at least about 6, and preferably is at least about 10. The value for each n usually ranges from about 12 to about 113. Typically the value for each p is in the range of from about 12 to about 43.

A more complete disclosure of soil release agents is contained in U.S. Pat. No. : 4,661,267, Decker, Konig, Straathof, and Gosselink, issued Apr. 28, 1987; U.S. Pat. No. 4,711,730, Gosselink and Diehl, issued Dec. 8, 1987; U.S. Pat. No. 4,749,596, Evans, Huntington, Stewart, Wolf, and Zimmerer, issued Jun. 7, 1988; U.S. Pat. No. 4,818,569, Trinh, Gosselink, and Rattinger, issued Apr. 4, 1989; U.S. Pat. No. 4,877,896, Maldonado, Trinh, and Gosselink, issued Oct. 31, 1989; U.S. Pat. No. 4,956,447, Gosselink et al., issues Sep. 11, 1990; and U.S. Pat. No. 4,976,879, Maldonado, Trinh, and Gosselink, issued Dec. 11, 1990, all of said patents being incorporated herein by reference.

These soil release agents can also act as scum dispersants.

4. Scum Dispersant

In the present invention, the premix can be combined with an optional scum dispersant, other than the soil release agent, and heated to a temperature at or above the melting point(s) of the components.

The preferred scum dispersants herein are formed by highly ethoxylating hydrophobic materials. The hydrophobic material can be a fatty alcohol, fatty acid, fatty amine, fatty acid amide, amine oxide, quaternary ammonium compound, or the hydrophobic moieties used to form soil release polymers. The preferred scum dispersants are highly ethoxylated, e.g., more than about 17, preferably more than about 25, more preferably more than about 40, moles of ethylene oxide per molecule on the average, with the polyethylene oxide portion being from about 76% to about 97%, preferably from about 81% to about 94%, of the total molecular weight.

The level of scum dispersant is sufficient to keep the scum at an acceptable, preferably unnoticeable to the consumer, level under the conditions of use, but not enough to adversely affect softening. For some purposes it is desirable that the scum is nonexistent. Depending on the amount of anionic or nonionic detergent, etc., used in the wash cycle of a typical laundering process, the efficiency of the rinsing steps prior to the introduction of the compositions herein, and the water hardness, the amount of anionic or nonionic detergent surfactant and detergency builder (especially phosphates and zeolites) entrapped in the fabric (laundry) will vary. Normally, the minimum amount of scum dispersant should be used to avoid adversely affecting softening properties. Typically scum dispersion requires at least about 2%, preferably at least about 4% (at least 6% and preferably at least 10% for maximum scum avoidance) based upon the level of softener active. However, at levels of about 10% (relative to the softener material) or more, one risks loss of softening efficacy of the product especially when the fabrics contain high proportions of nonionic surfactant which has been absorbed during the washing operation.

Preferred scum dispersants are: Brij 700; Varonic U-250; Genapol T-500, Genapol T-800; Plurafac A-79; and Neodol 25–50.

5. Bactericides

Examples of bactericides used in the compositions of this invention include glutaraldehyde, formaldehyde, 2-bromo-2-nitro-propane-1,3-diol sold by Inolex Chemicals, located in Philadelphia, Pa., under trade name Bronopol, and a mixture of 5-chloro-2-methyl-4-isothiazoline-3-one and 2-methyl-4-isothiazoline-3-one sold by Rohm and Haas Company under the trade name Kathon CG/ICP. Typical levels of bactericides used in the present compositions are from about 1 to about 1,000 ppm by weight of the agent.

6. Other Optional Ingredients

The present invention can include optional components conventionally used in textile treatment compositions, for example, short chain alcohols such as ethanol, or propylene glycol, colorants, perfumes, preservatives, optical brighteners, opacifiers, surfactants, stabilizers such as guar gum and polyethylene glycol, anti-shrinkage agents, fabric crisping agents, spotting agents, germicides, fungicides, anti-oxidants such as butylated hydroxy toluene, anti-corrosion agents, and the like.

The compositions of the present invention are preferably used in the rinse cycle of the conventional automatic laundry operations. Generally, rinse water has a temperature of from about 15° C. to about 60° C.

Fabrics or fibers are contacted with an effective amount, generally from about 20 ml to about 300 ml (per 3.5 kg of fiber or fabric being treated), of the compositions herein in an aqueous bath. Of course, the amount used is based upon the judgment of the user, depending on concentration of the softening materials, (A)+(B), fiber or fabric type, degree of softness desired, and the like. Typically, from about 20 ml to about 300 ml of 9% to 40% dispersion of the softening materials (A)+(B) are used in a 25 gallon laundry rinse bath to soften and provide antistatic benefits to a 3.5 kg load of mixed fabrics. Preferably, the rinse bath contains from about 20 ppm to about 250 ppm of the fabric softening materials (A)+(B) herein. More preferably for United States conditions, the rinse bath contains from about 50 ppm to about 150 ppm of the fabric softening materials (A)+(B). More preferably for European conditions, the rinse bath contains from about 250 ppm to about 450 ppm of the fabric softening materials (A)+(B). More preferably for Japanese conditions, the rinse bath contains from about 30 ppm to about 80 ppm of the fabric softening materials (A)+(B). These concentration levels achieve superior fabric softening and static control.

The invention is exemplified by the following non-limiting examples in which all numerical values are approximations consistent with normal experience.

| FORMULA | 1 Wt. % | 2 Wt. % | 3 Wt. % | 4 Wt. % | 5 Wt. % |
|---|---|---|---|---|---|
| Di(2-amidoethyl) methyl quaternary ammonium salt[1] | — | 6.25 | 12.50 | 18.75 | 25.00 |
| DEQA[2] | 24.5 | 18.75 | 12.50 | 6.25 | — |
| Tallow Alcohol Ethoxylate (10 Moles Ethoxylation) | 1.00 | 1.00 | 1.00 | 1.00 | 1.00 |
| Ethanol | 0.95 | 0.92 | 0.61 | 0.30 | — |
| Isopropanol | — | 0.68 | 1.39 | 2.08 | 2.78 |
| Perfume | 1.20 | 1.20 | 1.20 | 1.20 | 1.20 |
| Silicone DC-200* | 0.19 | 0.19 | 0.19 | 0.19 | 0.19 |
| Silicone Antifoam DC-2210 | 0.32 | 0.32 | 0.32 | 0.32 | 0.32 |
| Soil Release Polymer | 0.50 | 0.50 | 0.50 | 0.50 | 0.50 |
| HCl | 0.03 | 0.03 | 0.03 | 0.03 | 0.03 |
| Lysine HCl | 0.75 | 0.75 | 0.75 | 0.75 | 0.75 |
| Deionized Water | 70.56 | 69.40 | 69.01 | 68.63 | 68.23 |

*Product of the Dow-Corning Corporation.
[1]Di(2-tallowyamidoethyl)ethoxylated methyl ammonium methylsulfate (sold under the tradename Varisoft 222).
[2]N,N-di(hydrogenated tallowyl-oxy-ethyl) N,N-dimethyl ammonium chloride

EXAMPLE I PREPARATION

The first three ingredients in each Formula are co-melted in a pyrex beaker, covered with a concave watchglass, for three hours at about 80–85° C. to form the premix. The water, HCl, and silicone antifoam are separately weighed into a sealed container and heated to about 83° C. to form the water seat. The premix is then injected into the water seat over three to four minutes at about 72° C. while stirring at from about 1500 to about 3000 r.p.m. A 15% aqueous solution of Lysine/HCl is added to the water seat/premix dispersion over seven minutes at about 71° C. while stirring at from about 500 to about 1000 r.p.m. The perfume, and the silicone DC-200 are added to the dispersion over thirty seconds. The dispersion is milled for two minutes at about 70° C. at from about 4000 to about 8000 r.p.m. of the mill. A 40% aqueous solution of soil release polymer is added to the dispersion over two minutes at about 66° C. while stirring at from about 500 to about 1000 r.p.m. The dispersion is then chilled in an ice bath at about 25° C. for 8 minutes while stirring at from about 200 to about 500 r.p.m.

| Formula | Initial Viscosity (cP[3]) | # Days | 0° C. (cP) | 4° (cP) | 10° (cP) |
|---|---|---|---|---|---|
| 1 | 59 | 145 | Gel (2d[4]) | Gel (3d) | Gel (3d) |
| 2 | 243 | 28 | Gel (2d) | Gel (3d) | 275 |
| 3 | 281 | 28 | Gel (3d) | >500 | 248 |
| 4 | 143 | 28 | Did not gel | 133 | 132 |
| 5 | 155 | 28 | Did not gel | >500 | >500 |

[3]The abbreviation "cP" denotes centipoise.
[4]The abbreviation "d" denotes days.

Concentrated compositions containing mixtures of the two softener active materials, Component (A) and Component (B), (Formulas 2–4), have more stable viscosities at temperatures down to 10° C., than compositions containing only the individual softener active Component (A) or Component (B), (Formulas 1 and 5).

| FORMULA | 1 Wt. % | 2 Wt. % | 3 Wt. % |
|---|---|---|---|
| Ditallow Imidazoline | | | |
| Amide[5] | 25.00 | — | 16.67 |
| DEQA[6] | — | 25.00 | 8.33 |
| Soil Release Polymer | — | 0.5 | 0.17 |
| $CaCl_2$ | 0.4 | 0.35 | 0.38 |
| Perfume | 1.35 | 1.35 | 1.35 |
| DC-200 Silicone* | 0.19 | 0.19 | 0.19 |
| Silicone Antifoam DC-2210* | 0.32 | 0.32 | 0.32 |
| Preservative (Kathon) | 0.0003 | 0.0003 | 0.0003 |
| HCl | 1.70 | 0.02 | 1.14 |
| Ethanol | — | 3.5 | 1.17 |
| Deionized Water | 71.0 | 68.8 | 70.3 |

*Product of the Dow-Corning Corporation.
[5]1-[hydrogenated tallowyl amido]ethyl-2-hydrogenated tallow imidazoline
[6]N,N-di(hydrogenated tallowyl-oxy-ethyl)-N,N-dimethyl ammonium chloride

EXAMPLE II PREPARATION

Formula 1 Preparation

Ditallow Imidazoline Amide in the amount of 375 g is melted by heating to about 93° C. This molten softener is then dispersed into 376 g of deionized water at about 82° C. containing 90 g of a 28.25% HCl solution and 4.8 g of the DC-2210 silicone antifoam over five minutes while stirring with an IKA model RW20 DZM stirrer at 400–600 r.p.m. The resulting dispersion is stirred for an additional four minutes. A second aliquot of about 82° C. deionized water in the amount of 580 g is stirred into the thick dispersion over two and one half minutes. A blend of 20.25 g of perfume and 2.85 g of DC-200 silicone fluid is then added to the dispersion over thirty seconds, followed by two and one half minutes of mixing with an IKA ultra-Turrax T50 high shear mill at 8000 r.p.m. The dispersion is then cooled to room temperature over three minutes by passing it through a small plate and frame heat exchanger. The preservative in the amount of 0.3 g is added at room temperature following the cool down.

Formula 2 Preparation

N,N-di(hydrogenated tallowyl-oxy-ethyl)-N,N-dimethyl ammonium chloride in the amount of 431 g and 24 g of ethanol are melted at about 91° C. This molten softener is dispersed into 954 g of deionized water at about 82° C. containing 8.25 g of a 0.968 N HCl solution, 4.8 g of DC-2210 silicone antifoam and 18.75 g of a 40% solution of soil release polymer over five and one half minutes while stirring at 800–1100 r.p.m. Subsequently, 35 g of an aqueous 15% CaCl2 solution is stirred into the dispersion over four and one half minutes. A blend of 20.25 g of perfume and 2.85 g of DC-200 silicone fluid is then added to the dispersion over thirty seconds, followed by two and one half minutes of mixing with a high shear mill at 8000 r.p.m. The preservative in the amount of 0.3 g is added just prior to cool-out. The dispersion is then cooled to room temperature over two and one half minutes by passing through a small plate and frame heat exchanger.

Formula 3 Preparation

An amount of 105 g of Formula 2 is mixed with 210 g of Formula 1 at room temperature.

| Formula | Initial Viscosity (cP) | Days at 4° C. | Viscosity after exposure to 4° C. (cP) |
|---|---|---|---|
| 1 | 38 | 5 | >5000 |
| 2 | 78 | 3 | gelled |
| 3 | 43 | 3 | gelled |

The above table demonstrates the disadvantage of the preparation process in which the actives are not co-melted, as described in Example II. The use of a molten premix of the softener actives Component (A) and Component (B), provides a product with superior viscosity stability.

| EXAMPLE | III Wt. % | IV Wt. % | V Wt. % | VI Wt. % |
|---|---|---|---|---|
| Ditallow Imidazoline | | | | |
| Amide[7] | 14.3 | 14.3 | 14.3 | 11.0 |
| DEQA[8] | 7.7 | 8.7 | 9.7 | 12.0 |
| $CaCl_2$ | 0.375 | 0.375 | 0.375 | 0.375 |
| Perfume | 1.35 | 1.35 | 1.35 | 1.35 |
| DC-200 Silicone* | 0.19 | 0.19 | 0.19 | 0.19 |
| DC-2210 Silicone* | 0.32 | 0.32 | 0.32 | 0.32 |
| Preservative (Kathon) | 0.0003 | 0.0003 | 0.0003 | 0.0003 |
| HCl | 0.97 | 0.97 | 0.97 | 0.75 |
| Ethanol | 1.25 | 1.42 | 1.58 | 1.95 |
| Deionized Water | 73.5 | 72.3 | 71.2 | 72.1 |

*Product of the Dow-Corning Corporation.
[7]1-[hydrogenated tallowyl amido]ethyl-2-hydrogenated tallow imidazoline
[8]N,N-di(hydrogenated tallowyl-oxy-ethyl)-N,N-dimethyl ammonium chloride

EXAMPLE PREPARATION

Example III

Ditallow Imidazoline Amide in the amount of 214 g, 115.5 g N,N-di(tallowyl-oxy-ethyl)-N,N-dimethyl ammonium chloride and 19 g of ethanol are co-melted at about 91° C. This molten softener mixture is dispersed into 1,102 g of deionized water at about 82° C. containing 14.55 g of HCl and 4.8 g of DC-2210 silicone antifoam over five and one half minutes while stirring at 800–1100 r.p.m. Subsequently, 37.5 g of an aqueous 15% CaCl2 solution is stirred into the dispersion over four and one half minutes. A blend of 20.25 g of perfume and 2.85 g of DC-200 silicone fluid is then added to the dispersion over thirty seconds, followed by two and one half minutes of mixing with high shear mill at 8000 r.p.m. The dispersion is then cooled to room temperature over two and one half minutes by passing it through a small plate and frame heat exchanger.

The preservative in the amount of 0.3 g is added at room temperature following cool-out.

Examples IV, V and VI

These Examples are prepared in the same manner as Example III except that the amounts of imidazoline, N,N-di(hydrogenated tallowyl-oxy-ethyl)-N,N-dimethyl ammonium chloride, ethanol, and HCl vary according to the formulas shown above.

| Example | Initial Viscosity (cP) | Days at 4° C. | Viscosity after exposure to 4° C. (cP) |
|---|---|---|---|
| III | 18 | 42 | 60 |
| IV | 15 | 23 | 50 |
| V | 18 | 30 | 95 |
| VI | 18 | 29 | 33 |

This demonstrates the advantage of using a molten premix and the type of high shear dispersion that is possible with a high shear mill.

What is claimed is:

1. A stable, aqueous, liquid, concentrated fabric softening composition consisting essentially of:

(A) biodegradable diester quaternary ammonium fabric softening material selected from the group consisting of:

$$[(R)_{4-m}—N^{(+)}—[(CH_2)_n—Y—R^2]_m]X^{(-)} \quad (1)$$

wherein each R is selected from the group consisting of $C_1$ to $C_6$ alkyl, and $C_1$ to $C_6$ hydroxyalkyl groups; each m is 2 or 3; each n is from 1 to about 4; each $R^2$ is selected from the group consisting of from about $C_{12}$ to about $C_{22}$ hydrocarbyl and from about $C_{12}$ to about $C_{22}$ substituted hydrocarbyl group such that the IV of the parent fatty acid of this $R^2$ group is less than about 10; each Y is —O—(O)C— or —C(O)—O, but not OC(O)O; and wherein $X^{(-)}$ is a compatible anion; and (B) co-active fabric softening material selected from the group consisting of:

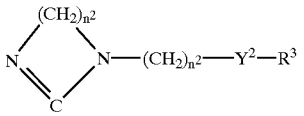

(1)

wherein each $Y^2$ is either: —N($R^4$)C(O)—, in which each $R^4$ is selected from the group consisting of $C_1$–$C_6$ alkyl, $C_1$–$C_6$ alkenyl, $C_1$–$C_6$ hydroxyalkyl group, and hydrogen; —OC(O)—; and a single covalent bond; and wherein each $R^3$ is a hydrocarbon group containing from about 11 to about 31 carbon atoms; and wherein each $n^2$ is independently from 2 to about 4;

(2)

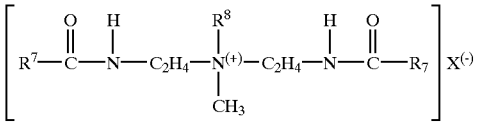

wherein each $R^7$ is selected from the group consisting of $C_{14}$ to $C_{20}$ alkyl and $C_{14}$ to $C_{20}$ alkenyl groups; each $R^8$ is selected from the group consisting of methyl, ethyl, and $—(C_mH_{2m}O)_n3H$; wherein $n^3$ is from 1 to about 5; and wherein each m, and $X^{(-)}$ are as hereinbefore;

(3)

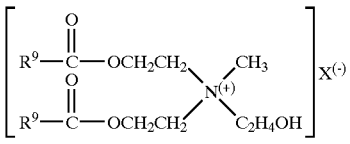

which is a diester quaternary ammonium compound formed from a parent fatty acid and triethanolamine wherein each $R^9$ is a $C_{15}$–$C_{17}$ fatty alkyl group such that the IV of the parent fatty acid of this $R^9$ group is from about 20 to about 100, and $X^{(-)}$ is as hereinbefore;

(4)

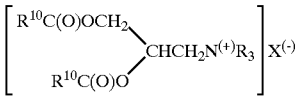

which is a diester quaternary ammonium compound formed from a parent fatty acid wherein each $R^{10}$ is a $C_{12}$–$C_{22}$ hydrocarbyl or a $C_{12}$–$C_{22}$ substituted hydrocarbyl substituent, such that the IV value of the parent fatty acid of this $R^{10}$ group is from about 20 to about 100, and R and $X^{(-)}$ are as hereinbefore; and mixtures thereof.

2. The composition according to claim 1 having a weight ratio of (A) to (B) of from about 0.2:1 to about 8:1.

3. The composition according to claim 2 wherein the ratio of (A) to (B) is from about 0.25:1 to about 4:1.

4. The composition according to claim 2 wherein the ratio of (A) to (B) is from about 0.3:1 to about 1.5:1.

5. The composition according to claim 1 wherein the total amount of components (A)+(B) is from about 20% to about 32%, by weight of the composition.

6. The composition according to claim 1 wherein the total amount of components (A)+(B) is from about 22% to about 27%, by weight of the composition.

7. The composition according to claim 1 prepared by using a molten premix comprising:

A. premixing (A) biodegradable diester quaternary ammonium fabric softening agent, and (B) co-active fabric softening material; and B. injecting the premix into an acid/water seat; and C. conducting high shear milling and adding electrolyte.

8. The composition according to claim 7 wherein said premix is combined with a scum dispersant.

9. The composition according to claim 7 wherein said acid/water seat has an acid concentration of up to about 2%.

10. The composition according to claim 7 having a molar ratio of the acid in the acid/water seat to (B) of from about 0:1 to about 1.2:1.

11. The composition according to claim 7 wherein the acid is selected from the group consisting of phosphoric acid, hydrochloric acid, citric acid, and mixtures thereof.

12. The composition according to claim 7 having a neat pH of from about 2.5 to about 4.

13. The composition according to claim 7 wherein the electrolyte is selected from the group consisting of salts of Group IA and IIA metals of the periodic table of elements.

14. The composition according to claim 7 wherein the electrolyte comprises an ammonium salt.

15. The composition according to claim 14 wherein the electrolyte is calcium chloride.

16. A stable, aqueous, liquid, concentrated fabric softening composition consisting essentially of:

(A) biodegradable diester quaternary ammonium fabric softening material selected from the group consisting of:

wherein said quaternary ammonium fabric softening material is formed from parent fatty acid and amine, wherein each R is selected from the group consisting of $C_1$ to $C_6$ alkyl, and $C_1$ to $C_6$ hydroxyalkyl groups; each m is 2 or 3; each n is from 1 to about 4; each $R^2$ is selected from the group consisting of from about $C_{12}$ to about $C_{22}$ hydrocarbyl and from about $C_{12}$ to about $C_{22}$ substituted hydrocarbyl group such that the IV of the parent fatty acid of this $R^2$ group is less than about 10; each Y is —O—(O)C— or —C(O)—O, but not OC(O)O; and wherein $X^{(-)}$ is a compatible anion; and (B) co-active fabric softening material having the formula:

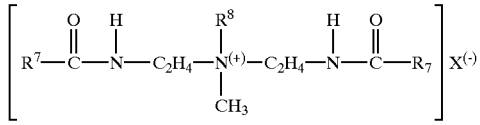

wherein each $R^7$ is selected from the group consisting of $C_{14}$ to $C_{20}$ alkyl and $C_{14}$ to $C_{20}$ alkenyl groups; each $R^8$ is selected from the group consisting of methyl, ethyl, and $—(C_mH_{2m}O)_n3H$; wherein $n^3$ is from 1 to about 5; and wherein each m, and $X^{(-)}$ are as hereinbefore; and wherein the total amount of components (A)+(B) is from about 15% to about 35%.

17. The composition according to claim 16 having a weight ratio of (A) to (B) of from about 0.2:1 to about 8:1.

18. The composition according to claim 16 wherein the ratio of (A) to (B) is from about 0.25:1 to about 4:1.

19. The composition according to claim 16 wherein the ratio of (A) to (B) is from about 0.3:1 to about 1.5:1.

20. The composition according to claim 16 prepared by using a molten premix comprising:

A. premixing (A) biodegradable diester quaternary ammonium fabric softening agent, and (B)co-active fabric softening material; and B. injecting the premix into an acid/water seat; and C. conducting high shear milling and adding electrolyte.

21. The composition according to claim 20 wherein said premix is combined with a scum dispersant.

22. A stable, aqueous, liquid, concentrated fabric softening composition consisting essentially of:

(A) biodegradable diester quaternary ammonium fabric softening material having the formula:

$$[(R)_{4-m}—N^{(+)}—[(CH_2)_n—Y—R^2]_m]X^{(-)}$$

wherein each R is selected from the group consisting of $C_1$ to $C_6$ alkyl, and $C_1$ to $C_6$ hydroxyalkyl groups; each m is 2 or 3; each n is from 1 to about 4; each $R^2$ is selected from the group consisting of from about $C_{12}$ to about $C_{22}$ alkyl and from about $C_{12}$ to about $C_{22}$ alkenyl groups, wherein said $R^2$ groups is derived from a parent fatty acid having an iodine values of less than about 10; each Y is —O—(O)C— or —C(O)—O, but not OC(O)O; and wherein $X^{(-)}$ is a compatible anion; and (B) co-active fabric softening material having the formula:

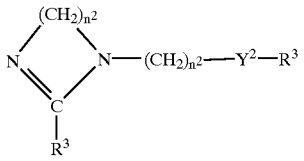

wherein each $Y^2$ is either: —$N(R^4)C(O)$—, in which each $R^4$ is selected from the group consisting of $C_1$–$C_6$ alkyl, alkenyl, hydroxyalkyl group, and hydrogen; —OC(O)—; or a single covalent bond; and wherein each $R^3$ is independently a hydrocarbon group containing from about 11 to about 31 carbon atoms; and wherein each $n^2$ is independently from 2 to about 4; and wherein (A)+(B) is from about 15% to about 35% by weight of the composition.

23. The composition according to claim 22 having a weight ratio of (A) to (B) of from about 0.2:1 to about 8:1.

24. The composition according to claim 22 wherein the ratio of (A) to (B) is from about 0.25:1 to about 4:1.

25. The composition according to claim 22 wherein the ratio of (A) to (B) is from about 0.3:1 to about 1.5:1.

26. The composition according to claim 22 prepared by using a molten premix comprising:

A. premixing (A) biodegradable diester quaternary ammonium fabric softening agent, and (B)co-active fabric softening material; and B. injecting the premix into an acid/water seat; and C. conducting high shear milling and adding electrolyte.

27. The composition according to claim 26 wherein said premix is combined with a scum dispersant.

28. A stable, aqueous, liquid, concentrated fabric softening composition consisting essentially of:

(A) biodegradable diester quaternary ammonium fabric softening material selected from the group consisting of:

$$[(R)_{4-m}—N^{(+)}—[(CH_2)_n—Y—R^2]_m]X^{(-)}$$

wherein said quaternary ammonium fabric softening material is formed from parent fatty acid and amine, wherein each R is selected from the group consisting of $C_1$ to $C_6$ alkyl, and $C_1$ to $C_6$ hydroxyalkyl groups; each m is 2 or 3; each n is from 1 to about 4; each $R^2$ is selected from the group consisting of from about $C_{12}$ to about $C_{22}$ hydrocarbyl and from about $C_{12}$ to about $C_{22}$ substituted hydrocarbyl group such that the IV of the parent fatty acid of this $R^2$ group is less than about 10; each Y is —O—(O)C— or —C(O)—O, but not OC(O)O; and wherein $X^{(-)}$ is a compatible anion; and (B) co-active fabric softening material having the formula:

(3)

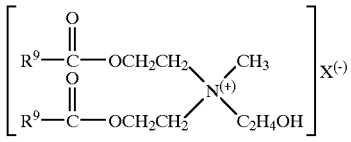

wherein said material is diester quaternary ammonium compound formed from parent fatty acid and triethanolamine wherein each $R^9$ is a $C_{15}$–$C_{17}$ fatty alkyl group such that the IV of the parent fatty acid of this $R^9$ group is from about 20 to about 100, and $X^{(-)}$ is as hereinbefore.

* * * * *